United States Patent [19]

Rollins

[11] 4,408,187

[45] Oct. 4, 1983

[54] CUEING DEVICE

[76] Inventor: Edward J. Rollins, P.O. Box 523, Meadow Vista, Calif. 95722

[21] Appl. No.: 212,080

[22] Filed: Dec. 1, 1980

[51] Int. Cl.[3] ..... G08B 5/00; H05B 39/00

[52] U.S. Cl. ..... 340/332; 340/82; 340/286 R; 340/321; 340/333; 340/309.15; 340/815.01; 340/815.21; 340/43

[58] Field of Search ..... 340/332, 333, 321, 82, 340/83, 286 R, 286 M, 309.1, 309.2, 309.4, 313, 815.01, 815.02, 815.21, 43; 315/200 A

[56] References Cited

U.S. PATENT DOCUMENTS

| | | | |
|---|---|---|---|
| 2,683,868 | 7/1954 | McKnight | 340/43 |
| 3,200,218 | 8/1965 | Wagner | 340/43 |
| 3,475,747 | 10/1969 | Kratomi | 340/286 R |
| 3,553,528 | 1/1971 | Somlyody | 340/332 |
| 3,573,792 | 4/1971 | Reed | 340/286 M |
| 3,623,066 | 11/1971 | Norris | 340/332 |
| 3,694,808 | 9/1972 | Booth | 340/332 |
| 3,889,252 | 6/1975 | Cox et al. | 340/313 |
| 3,943,641 | 3/1976 | Dworetzky | 340/332 |
| 4,234,869 | 11/1980 | Sandleman | 340/286 M |

*Primary Examiner*—Donnie Lee Crosland
*Attorney, Agent, or Firm*—Charles H. Schwartz; Ellsworth R. Roston

[57] ABSTRACT

A cueing device for use in providing a visual cueing signal to a performer, including a plurality of visual indicators arranged adjacent each other for providing a visual cueing signal in accordance with the actuation of individual ones of the plurality of visual indicators. The individual ones of the visual indicators are individually controlled and with the visual indicators controlled by sequential actuation to provide sequential visual signals serving as a visual cueing signal to a performer. The entire cueing cycle is initiated by an input signal.

10 Claims, 3 Drawing Figures

CUEING DEVICE

The present invention is directed to an apparatus and method for use in providing a visual cueing signal for use in cueing a performer for smooth entrances and exits during a performance. In particular, the apparatus and method of the present invention may be used for cueing the performer either during a live performance or during the taping or filming of a performance.

With a particular embodiment of the apparatus and method of the present invention, a plurality of visual indicators are mounted adjacent to each other and in close proximity to a camera which is to record the performance. Specifically, five (5) such visual indicators, which may be incandescent lamps, are mounted along a straight line. Initially, all of the lights are illuminated, then all of the lights blink off and four (4) of the lights are then illuminated. The four (4) lights then blink off and three (3) of the lights are illuminated. The procedure continues by progressively reducing the number of illuminated lamps, until all of the lights are extinguished. Each alternation of illuminating a group of lights and then blinking the lights off take approximately one (1) second so that the five (5) light sequence provides an approximate five second cue signal to the performer. The cueing signal may be used to cue the entrance or exit of the performance before the camera.

Generally, with a cueing device constructed in accordance with the teaching of the present invention, the incandescent lamps are mounted behind a lens, such as a red lens, and with the lens formed as a circular defraction grading to focus the light produced by the lamp. The use of the lens combined with the blinking action of the lights creates a highly-visible cueing signal. In addition, the use of the red color for the lens provides a psychologically stimulating color for the average human and in particular performers are used to the use of a red light to indicate that a camera is on. The use of the blinking action and the lens thereby provides for a dramatic change each time the lights blink and the human eye is very responsive to such changes.

With the cueing device of the present invention, the cueing device may be mounted close by the camera, such as immediately above the camera lens. Therefore, the performer is able to watch the cueing device, while to the viewer the performer appears to maintain eye contact. In addition, the cueing device of the present invention provides a cueing signal which is entirely graphic in that the visual signal is a succession of blinking lights and with the number of lights progressively reduced each time the lights blink. Therefore, the visual signal produced by the cueing device of the present invention is universal and can be used to cue performers of any nationality since the performer doesn't have to understand the spoken word. This has produced difficulties in the past since the present standard cueing technique for entrances is to provide a countdown of "five-four-three-two-one".

It should be appreciated that although the present invention will be described with reference to the use of incandescent lamps, other types of visual illuminating devices such as solid state devices may be used. In addition, although the invention will be described with the use of five (5) lights and with all five (5) of the lights initially lit and with one (1) light extinguished each time the lights are blinked, other arrangements and sequences of lights may be used. For example, a number larger than five (5) lights may be used or the lights may be blinked to have one (1) light added each time there is a blinking action or combinations of the above may be used to provide for periods greater than five (5) seconds or less than five (5) seconds. One specific example would be used of five (5) lights and with the lights initially all extinguished and with one (1) light added with each blink until all five (5) lights are illuminated and then with a reversal wherein the lights are extinguished one at a time as the group of lights are blinked. This would provide for a cueing period of ten seconds if there is one second period between each blink.

This and other aspects of the present invention will be clearer with reference to the following descriptions and drawings wherein.

Figure 1:
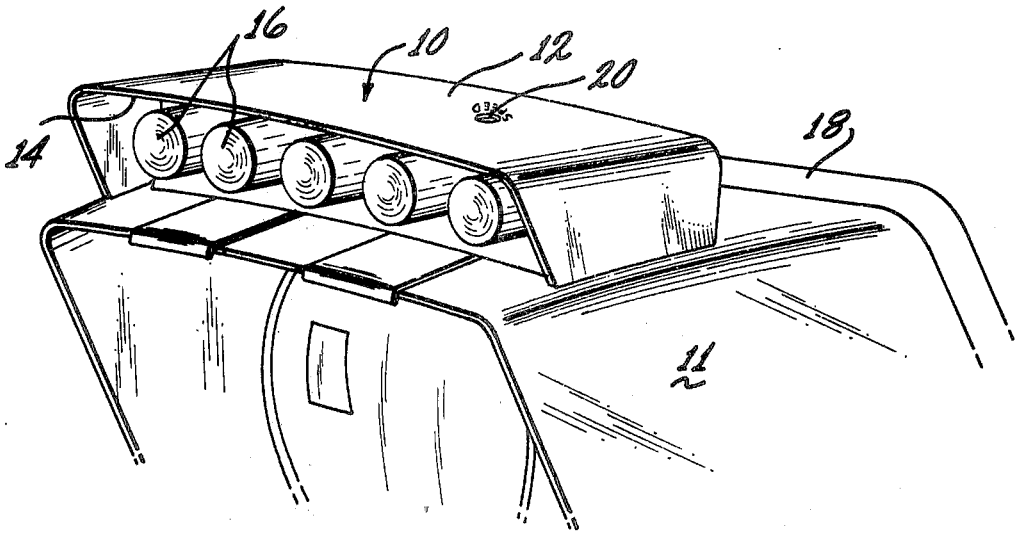
FIG. 1 illustrates a cueing device of the present invention mounted atop a television camera.

As shown in FIG. 1, a cueing device 10 constructed in accordance with the teachings of the present invention is mounted on top of a television camera 11. The cueing device 10 may be mounted by any appropriate means such as a clip or magnet. The cueing device 10 includes a housing 12 having a hooded section 14 extending above and around both sides of a plurality of lights 16. The hooded section shields the lights 14 from much of the ambient light which would be present in a studio. This allows the lights 16 to provide for a large visual change in brightness when the lights are illuminated.

In a particular method of operation of the present invention, the start of the cue provides for the illumination of all five (5) lights 16. The lights are blinked off and then the four (4) right hand lights are illuminated so that the extreme left light is extinguished. The four (4) lights are then blinked off and the three (3) right hand lights are illuminated. The process is repeated until all of the lights are extinguished. The time period between each alternation is approximately one (1) second so that the total cueing time is five (5) seconds. The performer therefore sees the sequence of blinking lights and with one (1) light extinguished after each blinking action so that on the final blinking the last light is extinguished and the performer knows to provide the appropriate extrance or exit.

A cable 18 extends from the back of the cueing device 10 and the cable is used to provide for remote actuation of the cueing device. A speed control 20 mounted on the top of the cueing device provides for minor adjustments in the speed of operation of the cueing device to ensure that the proper cueing period is provided.

Figure 2:
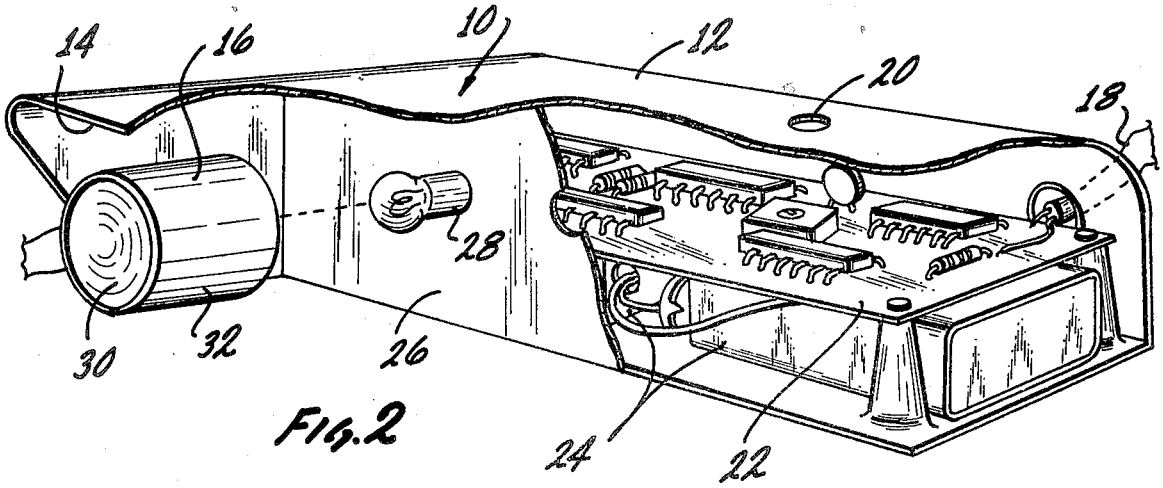
FIG. 2 illustrates a partially broken-away view of the cueing device of the present invention and illustrating an individual lamp.

FIG. 2 illustrates a partially broken-away view of the cueing device of FIG. 1. As seen in FIG. 2 the interior of the cueing device includes a circuit board 22 for supporting various circuit components above a pair of batteries 24. The housing 12 includes a front panel 26 which supports the lights 16 below the hooded area 14. Each light 16 includes an incandescent lamp 28 and with a lens structure 30 mounted at the front of a cylindrical housing 32 in front of each lamp 28. The lens 30 may be formed as a circular defraction grading and with the lens having a red color to provide for a highly-visible focused red light from each incandescent lamp 28.

Figure 3:
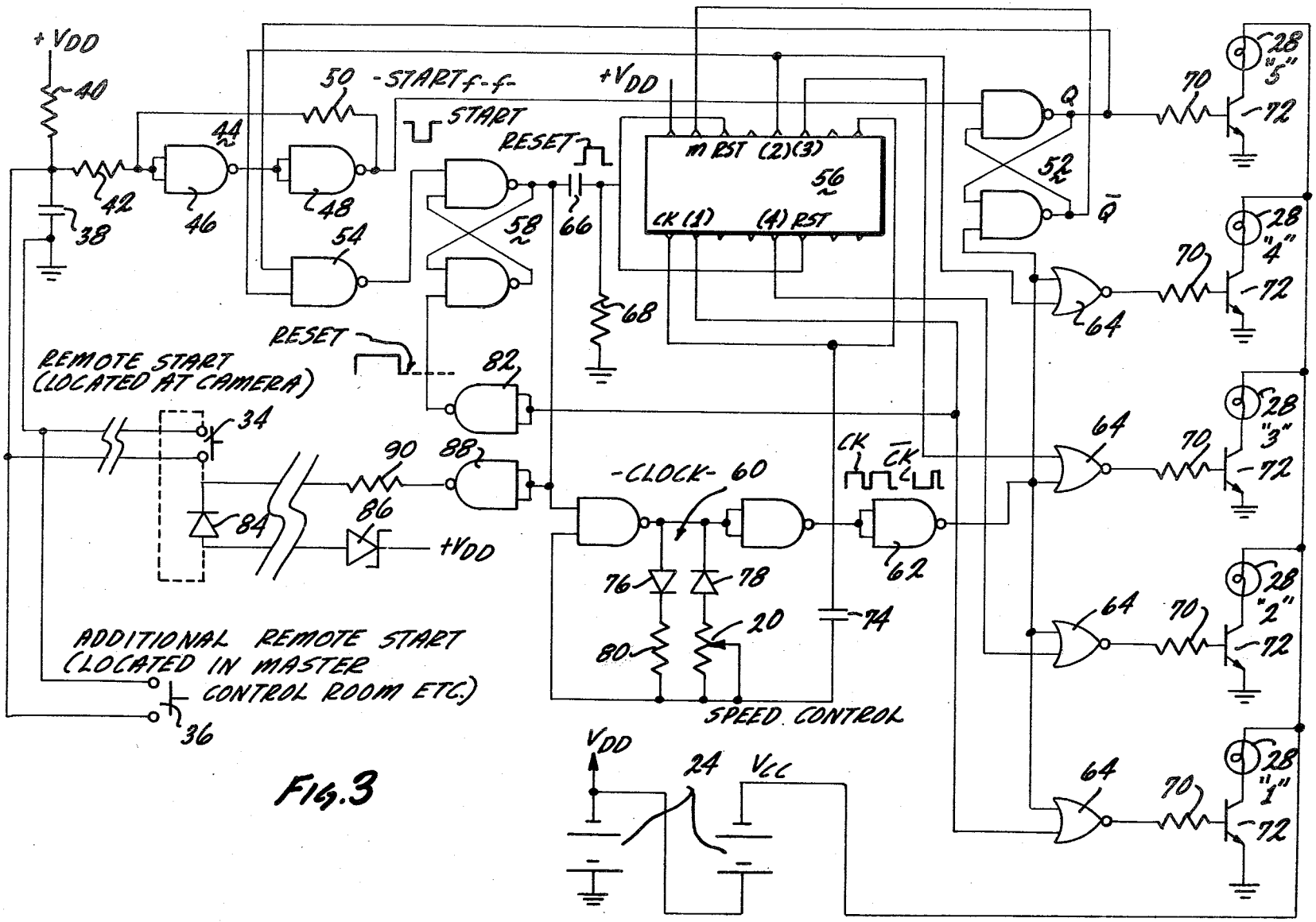
FIG. 3 illustrates a circuit diagram of a specific embodiment of a cueing device of the present invention.

FIG. 3 illustrates a circuit diagram of a specific embodiment of the cueing device of the present invention. As shown in FIG. 3 the pair of batteries 24 provides for a voltage source to the various components of the circuit. The circuit may be actuated by a remote start button and as shown in FIG. 3 there may be a first remote start button 34 which may be located at the camera and a second remote start button 36 which may be located in the master control room.

A capacitor 38 stores a positive charge fed to the capacitor through a resistor 40. The capacitor 38 is coupled through a resistor 42 to the input to a Schmitt trigger stage 44. The Schmitt trigger includes a pair of gates 46 and 48 and a resistor 50. When either of the remote start buttons is closed then the capacitor 38 and thereby the input to the Schmitt trigger 44 is brought to a low potential such as a ground potential. The Schmitt trigger was previously maintained in an output high condition by the voltage across the capacitor 38 but when the capacitor is grounded the Schmitt trigger snaps over to an output low condition which is used to set a flip-flop 52.

When the flip-flop 52 is set, the Q output is used as an input to a gate 54 while the other input to the gate 54 is from any one of the active ports on an integrated circuit chip 56. The chip 56 is a dual four stage shift register which is cascaded to form an eight stage shift register. An output from the gate 54 is used to set a start flip-flop 58. By setting the start flip-flop 58 after the flip-flop 52 is set this ensures that the start flip-flop 58 cannot start until after data has been loaded into the system and thereby prevents false operation of the circuit.

When the start flip-flop 58 is set, the Q output of the start flip-flop goes to a high state and this high state is coupled directly as an enabling input to a clock 60. The clock 60 then produces an output clock signal as shown in FIG. 3, which clock signal is then inverted by gate 62 to produce an inverted clock signal. The inverted clock signal is used as one input to a plurality of identical NOR gates 64 and also as a reset input to the flip-flop 52.

The Q output high state from the start flip-flop 58 is also used to produce a brief high pulse formed at the junction of a capacitor 66 and a resistor 68. This brief pulse is then used as a reset pulse for the shift register 56. The reset pulse causes an output low for all eight stages of the shift register 56.

A data input is fed to the shift register 56 from the $\overline{Q}$ output of the flip-flop 52. Therefore, upon the first clock pulse from the clock 60 which occurs almost simultaneously with the reset pulse, the shift register 56 clocks in a low logic state. When the next clock pulse is produced by the clock 60, the flip-flop 52 has been reset and therefore its $\overline{Q}$ output goes to a high state and a high logic state is clocked into the first stage of the shift register 56. Subsequent clock pulses from the clock 60 shift the high logic state of the shift register 56 to succeeding stages. The high logic state being clocked through the individual outputs of the shift register 56 is used to provide for the sequential lamp extinguishing of the plurality of lamps 28. Since the data is fed into the shift register 56 through the $\overline{Q}$ output of the flip-flop 52, this successfully delays the high logic for one clock interval to thereby prevent the display from going from five (5) lights lit to three (3) lights lit, thereby skipping the four light display.

The shift register produces the individual outputs designated (4), (3), (2), and (1) and each of these outputs is independently combined with the inverted clock waveform in the individual NOR gates 64. When either of the signals to any NOR gate 64 goes to a high state, the output of the particular NOR gate goes low. The output from each NOR gate is coupled through one of a plurality of resistors 70 which forms an input to a plurality of lamp driving transistors 72. The output of the flip-flop 52 is also coupled through a resistor 72 to a lamp driving transistor 72. The low state of any of the outputs from any NOR gate 64 or the flip-flop 52 turns off the particular lamp driving transistor 72.

Therefore, when data from any one of the outputs of the shift register 56 goes to a high state the particular associated lamp 28 will remain extinguished for the remainder of the five (5) seconds cueing cycle. Also, when the inverted clock signal goes through the positive part of its cycle, all of the NOR gates that are still held active by data from the shift register 56 are forced low until the inverted clock signal returns to its negative state. This creates the blinking action of the display.

As shown in FIG. 3, the four NOR gates 64 control the illumination of the lamps 28 which are designated "4", "3", "2" and "1". The lamp designated "5" is driven directly by the flip-flop 52. Since the flip-flop 52 is reset by the first positive part of the first inverted clock signal, the lamp 28 designated as "5" blinks off in synchronism with the other four (4) lamps. The lamp designated "5" is then extinguished throughout the remainder of the clock cycle so that successive resets of the flip-flop 52 by the inverted clock signal have no effect on the display.

The clock 60 is enabled by the high Q output of the start flip-flop 58. Once the clock 60 is enabled, the clock alternately charges and discharges a capacitor 74, thereby creating the clock waveform shown in FIG. 3. The diodes 76 and 78 cause the charging and discharging to occur through two separate paths. The clock waveform may therefore be controlled to be asymetrical and specifically the clock waveform has duty cycle ratio of approximately three (3) parts high state to one (1) part low state. The low part of the cycle is fixed to be approximately a quarter second in accordance with the resistance values of the diode 76 and a resistor 80. The high part of the cycle is variable by means of the speed control 20 which is a variable resistor. The variable resistor 20 may therefore be adjusted so that the clock cycle occurs in the desired time.

In practice, it has been found that it is better to make each clock cycle slightly less than one (1) second to thereby provide for an overall duration of slightly less than five (5) seconds for a five (5) second cue. This allows the performer, for example, to carry an exit all the way to the end of the five (5) second display but still allowing enough of a pause to provide for a clean transition to the next scene without chopping off the last syllable spoken by the performer. Even though the use of a cue slightly less than five (5) seconds tends to cause the entrance cue to arrive slightly early, the performers are generally aware of the red mike on light on the camera which indicates the actual start of an entrance. Moreover, it has been determined that most performers have developed a pattern of breathing for entrances which generally includes inhaling and then starting to exhale as they begin to speak which provides for an automatic slight delay in the entrance.

Power is supplied to the circuit of FIG. 3 by the batteries 24. As can be seen one of the batteries is used to provide for a voltage $V_{DD}$ for all of the logic circuitry and the two batteries in series provides for a voltage $V_{CC}$ for use in powering the incandescent lamps 28. The circuit of FIG. 3 draws very little power since all of the logic circuitry may be composed of C-MOS chips which use very low amounts of power. The five (5) lamps 28 do use a fair amount of current but only for the five (5) second cueing period minus the blinking off periods.

The circuit of FIG. 3 does not include an on-off switch and the circuit is always ready for operation. The circuit automatically turns off once the last lamp designated "1" goes out. This is accomplished by feeding the (1) output signal from the shift register 56 through an inverter 82 to provide for a reset signal for the start flip-flop 58. The reset signal also disables the clock 60 because of the changed condition of the start relay 58. The reset holds the start flip-flop 58 off and holds the clock disabled until the arrival of another start command by either of the remote start buttons 34 and 36. These start commands will drive the (1) output from the shift register 56 low and the reset input high in the manner previously described.

Since the C-MOS devices change their state at low frequencies, the power consumption is very small. Also, once the clock is disabled, nothing in the logic circuitry is changing state and the only demands on the power supply is to maintain in a fixed state several of the logic elements.

The display may also include a battery state indicator including an LED 84 in series with a zener diode 86. The LED 84 and diode 86 are the Q output from the start flip-flop 58 using an inverter 88 and a resistor 90. During normal operation when the start command initially causes all five (5) lamps 28 to light, the battery voltage dips down and then returns as all the lamps blink off. The LED 84 also blinks since the battery is heavily loaded. However, the loading is progressively lightened as lamps are progressively extinguished during the cueing cycle so that the LED 84 will light during the latter portions of the cueing cycle. This indicates that the battery voltage is sufficient for circuit operation. As the batteries progressively weaken after prolonged use, the LED 84 blinks more times during the cueing cycle. Eventually, when the battery is below the desired voltage level the LED does not come on at all during the cueing cycle so as to indicate that the batteries should be changed. The battery state indicator is only operated during the actual cueing cycle so as not to provide for undue drain on the batteries when the cueing device is not in use. It can also be seen in FIG. 3 that the LED 84 may be positioned adjacent the remote start 34 so that the operator of the cueing device can see when the batteries are getting weak.

The present invention therefore provides for a cueing device for use in cueing entrances and exits of performers. The cueing device of the present invention may be used, for example, to free the floor director from the normal routine of counting out the cues thereby enabling the floor director to attend to other activites which are necessary to provide for a smoothly run performance. Moreover, the cueing device may be used even when there is no floor director so that the cueing may be provided by the cameraman or by a director in the control room. Cueing may therefore be accomplished from a remote position so that it is not necessary to have someone providing cueing right on the floor of the studio. The present invention therefore provides for a simple and yet reliable and economic approach to making the necessary split second transitions encountered in every day television and film production and with these transitions executed smoothly from a remote location with the convenience of merely pushing a button.

Although the present invention has been described with reference to a particular embodiment, it is to be appreciated that various adaptations and modifications may be made and the invention is only to be limited by the appended claims.

I claim:

1. A cueing device for use in providing a visual cueing signal to a performer, including a plurality of visual indicators arranged adjacent each other for providing a visual cueing signal in accordance with a fixed program producing a sequential actuation of individual ones of the plurality of visual indicators to form a single cueing cycle spanning a predetermined period of time, a plurality of first means individually coupled to individual ones of the visual indicators for individually controlling the actuation of the individual ones of the plurality of visual indicators, second means coupled to the plurality of first means for controlling the individual ones of the first means in accordance with the fixed program to sequentially actuate the individual ones of plurality of visual indicators to produce sequential visual signals through the single cueing cycle spanning the predetermined period of time to serve as the visual cueing signal to a performer, the second means controlling the individual ones of the first means in groups to produce sequential group visual signals and wherein the sequential group visual signals include alternate illumination and blinking off of groups of the visual indicators and wherein the alternate illumination and blinking off of groups of the visual indicators provides a progressive reduction of the number of visual indicators in the groups, and third means coupled to the second means for initiating the single cueing cycle spanning the predetermined period of time by initiating the operation of the second means.

2. The cueing device of claim 1 wherein the plurality of visual indicators are light sources and additionally including a lens mounted in front of each light source to focus the light from the light source.

3. The cueing device of claim 2 wherein each lens is of a red color.

4. The cueing device of claim 1 wherein the plurality of visual indicators are light sources and wherein the light sources are hooded to shield the light sources from ambient light.

5. The cueing device of claim 1 wherein there are five visual indicators and with the second means providing a cueing sequence by initially controlling the activating of all five of the visual indicators and then progressively reducing one visual indicator each time the visual indicators are blinked off and then illuminated until none of the visual indicators is illuminated.

6. The cueing device of claim 5 wherein the time period for the cueing sequence is approximately five (5) seconds.

7. The cueing device of claim 1 wherein the second means includes a shift register and a clock producing clock signals coupled to the shift register and with the shift register producing progressive individual signals to control the individual ones of the first means and with the progressive individual signals in accordance with clock signals.

8. The cueing device of claim 1 wherein the third means includes a remote actuator for initiating the operation of the second means.

9. A method of providing a visual cueing signal from a plurality of visual indicators arranged adjacent each other, including the following steps:

producing a visual indication from all of the visual indicators, blinking off all of the visual indicators and then producing a visual indication from one less than all of the visual indicators, and alternately blinking off and producing a visual indication from a number of the visual indicators and with the number progressively reduced by one with each alternation until the number reaches zero.

10. The method of claim 9 for use with a plurality of five (5) visual indicators and with each alternation having a time period of approximately one (1) second for producing a total time period of approximately five (5) seconds.

* * * * *